US006168539B1

(12) United States Patent
Maina

(10) Patent No.: US 6,168,539 B1
(45) Date of Patent: Jan. 2, 2001

(54) SOCCER BALL SPIN TRAINING TETHER

(76) Inventor: Ryan Maina, P.O. Box 161291, Louisville, KY (US) 40256-1291

( * ) Notice: Under 35 U.S.C. 154(b), the term of this patent shall be extended for 0 days.

(21) Appl. No.: 09/179,479

(22) Filed: Oct. 27, 1998

(51) Int. Cl.[7] ..... A63B 69/00
(52) U.S. Cl. ..... 473/424; 473/429; 473/446
(58) Field of Search ..... 473/424, 429, 473/423, 430, 425–428, 446, FOR 212

(56) References Cited

U.S. PATENT DOCUMENTS

| | | | | |
|---|---|---|---|---|
| 3,588,104 | | 6/1971 | Griffin . | |
| 3,804,409 | | 4/1974 | Schachner . | |
| 4,071,241 | * | 1/1978 | Garcia | 473/424 |
| 4,247,117 | * | 1/1981 | Reichert | 473/424 |
| 4,278,257 | | 7/1981 | Garcia et al. . | |
| 4,350,338 | | 9/1982 | May . | |
| 4,462,599 | | 7/1984 | Brown . | |
| 4,576,379 | | 3/1986 | Juhasz . | |
| 4,687,209 | * | 8/1987 | Carey | 473/424 |
| 5,083,797 | * | 1/1992 | Vartija et al. | 473/424 |
| 5,398,940 | | 3/1995 | Derst . | |
| 5,454,032 | | 9/1995 | Krietzman . | |
| 5,586,760 | * | 12/1996 | Hauter | 473/424 |
| 5,620,186 | | 4/1997 | Dudley . | |
| 5,692,975 | | 12/1997 | Hesse . | |

* cited by examiner

*Primary Examiner*—Mark S. Graham
(74) *Attorney, Agent, or Firm*—Carrithers Law Office; David W. Carrithers

(57) ABSTRACT

An apparatus for soccer kicking practice comprises a means of attaching a tether comprising a cord and elastic strip to a soccer ball in a manner allowing the ball to freely rotate with respect to the tether providing kicking and spinning of the ball and return of the ball to the user in a controlled manner.

20 Claims, 5 Drawing Sheets

SOCCER BALL SPIN TRAINING TETHER

BACKGROUND OF THE INVENTION

The present invention relates to an apparatus for soccer kicking practice comprises an elastic return cord and a non-elastic cord attached to the ball to permit spinning of the ball and return of the ball in a controlled manner.

In the game of soccer, it is important to have good ball control, to be able to make accurate passes, to have good kick control, and confidence in ones ability to repeatably kick the ball with anticipated and expected returns.

It is desirable to be able to practice kicking a soccer ball without the necessity of having another party retrieve the ball or having to retrieve the ball themselves. It may also be desirable to practice kicking the ball in a confined area such as indoor depending upon the weather conditions and practice space available to the kicker. It is also important to provide a means for storing and retrieval of the return apparatus with relative ease.

In most instances, players cannot pass the ball with their hands when it is in motion and must use their feet. The ball is primarily guided by the angle of the ball coming off the players, head or shoe. It is possible to also guide the ball by imparting back spins, or side spins to the ball causing the ball to curve up, down, or to one side or the other.

None of the conventional return devices provide a means for kicking the ball resulting in a "controlled" spin to affect the direction and path of the ball on the ground and/or through the air. Moreover, none of the typical devices now available provide a tethering return means whereby the attachment means to the tether does not interfere with the kick.

SUMMARY OF THE INVENTION

A tether is a attached to a soccer ball at a selected single point so that a spin may be imparted to the ball upon the ball being kicked by a player. A portion of the tether is elastic and a portion of the tether is comprised of nonelastic material whereby the user can kick the ball and the ball will return to the kicker. Use of a elastic and nonelastic tether provides a means for the kicker to control the distance of the kick and the height and direction that the ball will travel upon returning to the kicker so that the ball may be kicked or butted repeatedly with reliable anticipation of the position of the ball upon the return.

For instance, by attaching the elastic portion of the tether to the ball and holding on to the nonelastic end, kicking the ball will result in its going outward from the kicker's foot at around knee height or below skimming the ground. In order to provide a higher return, the kicker can shorten the length of the nonelastic portion by adjusting his or her grip on the tether so that kicking the ball results in the ball returning at waist level or at the level of the hand when the ball reaches its farther most distance when the elastic portion is fully extended.

The instant invention is especially good for training of a goalie wherein the ball can be bounced off of the ground and return to the goalie at head level.

The preferred embodiment uses a tether which is the length of the player from the tip of his fingers to the floor, generally from eight to ten feet, wherein a the section of the tether next to the player is formed of an elastic material so that the ball can be kicked and it returns to the player with the desired speed in an anticipated direction.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The soccer ball spin training tether 10 will now be described with reference to the drawings FIGS. 1.6.

Figure 1:
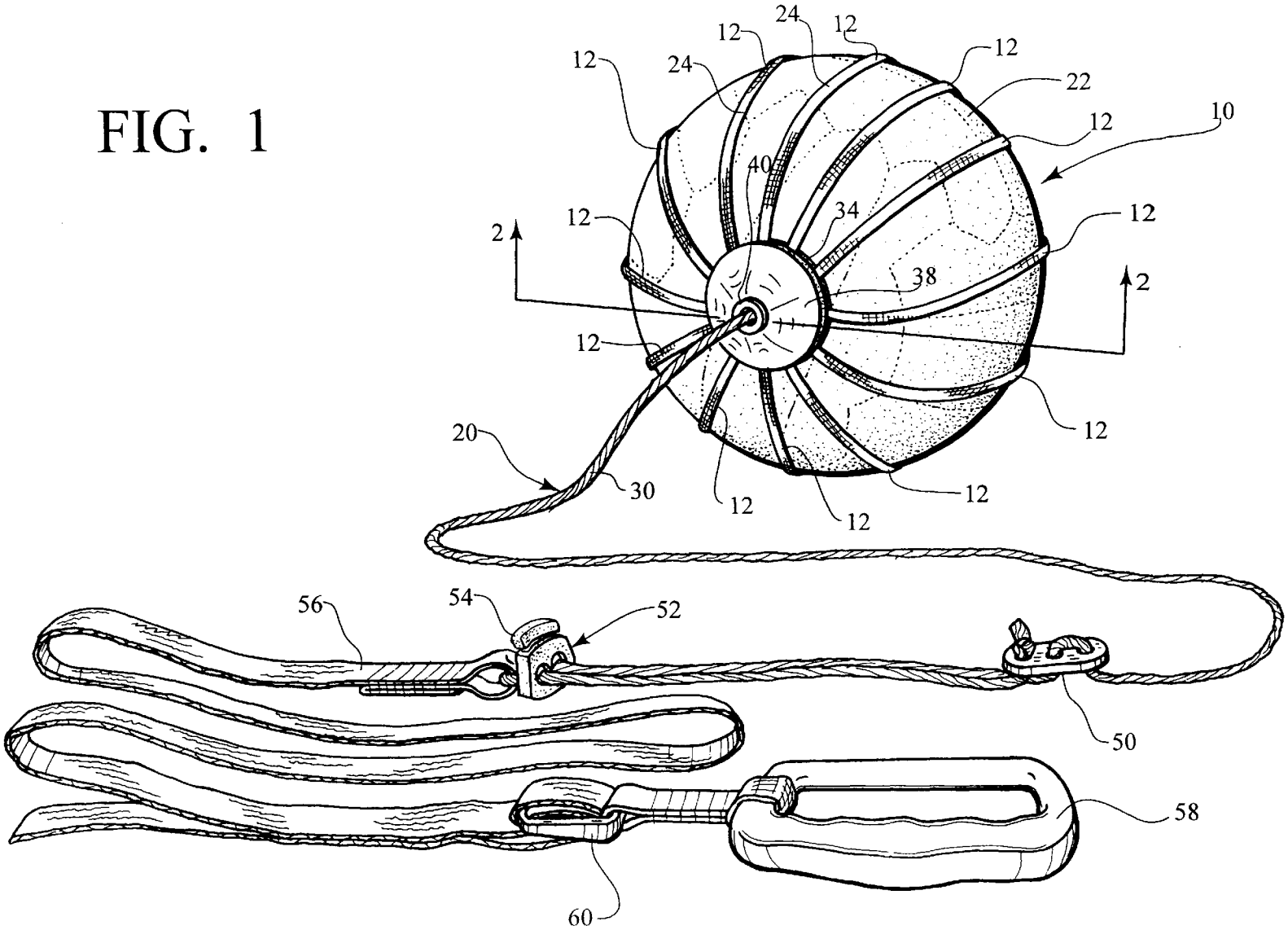
FIG. 1 is a perspective view of the present invention showing a soccer ball having the tether extending from a single point, wherein the tether is attached to the ball by removable means comprising a plurality of removable hook and loop fastening strips extending longitudinally around the circumference of the ball meeting at a central axis at a selected north or south point, and the tether composed of an elastic and a nonelastic portion.

As shown in FIG. 1, a conventional regulation soccer ball 10 is wrapped with a plurality of VELCRO™ strips comprising either hook or loop fasteners 12 on one side and fabric on the opposite side. The hooks 14 are generally formed of plastic material, the loops 16 comprise a mesh of fibers which may also be synthetic fibers formed from polymers or natural material such as cotton or wool. The backing fabric 18 on the strips may be fabricated from cloth or polymer fibers. Hook and loop fasteners 12 such as described in U.S. Pat. Nos. 4,872,243; 5,368,549; 5,315,740; 5,260,015; 4,984,339; 4,794,028; 5,339,499 all of which are hereby incorporated by reference, may be employed in the present invention.

The soccer ball spin training tether 10 of the present invention showing a soccer ball includes a tether 20 fastened to the ball be means for fastening extending from a single point providing a means for unrestricted spinning of the ball 22, wherein the tether 20 is attached to the ball 22 by removable means comprising a plurality of removable hook and loop fastening strips 24 extending longitudinally around the circumference of the ball 22 meeting at a central axis at a selected north or south point where they either overlap or intersect depending upon the method of attachment to the ball 22 and/or tether 20. The strips 24 may be removable and splicable.

Figure 6:
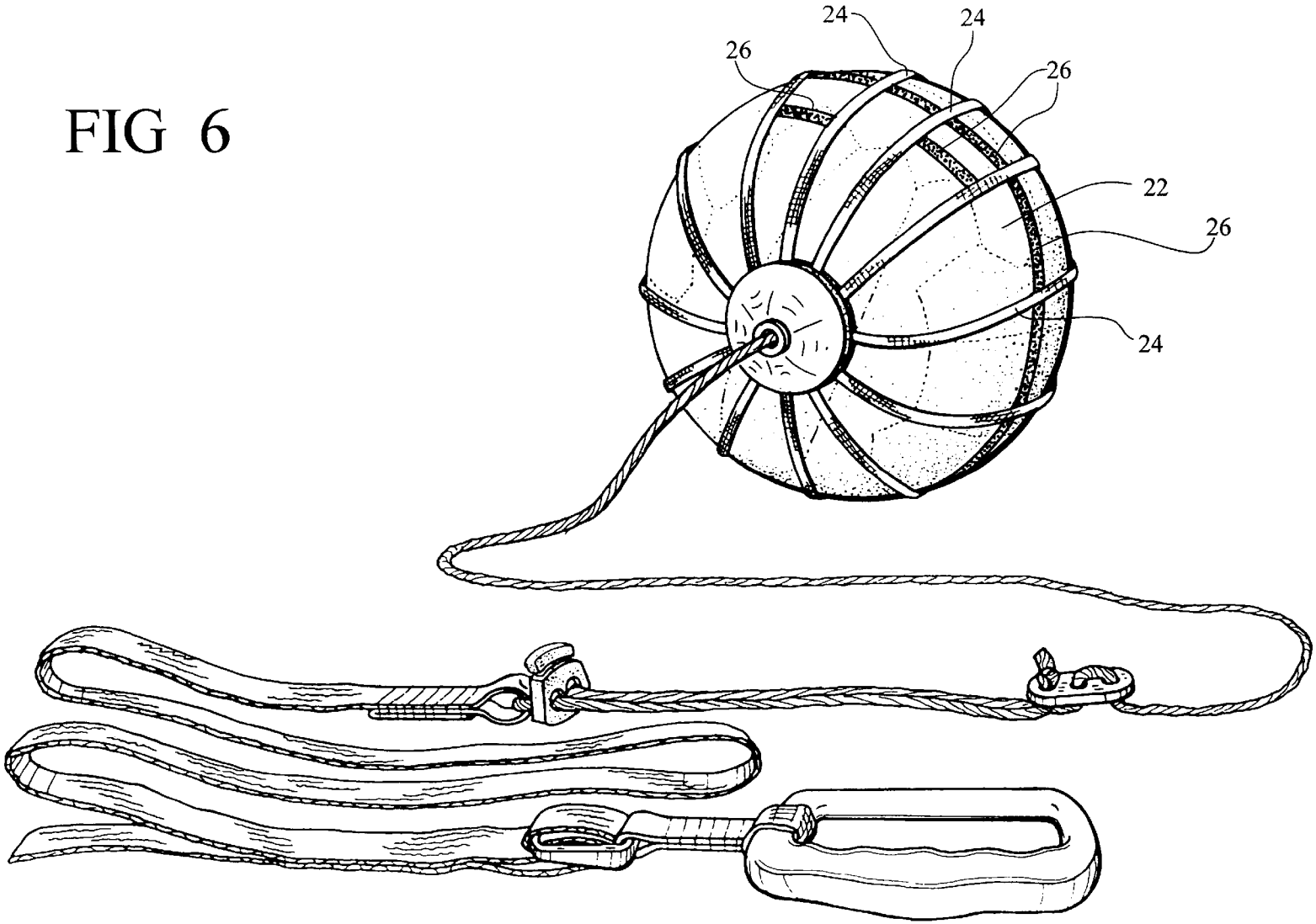
FIG. 6 is a perspective view of FIG. 1, showing a hook and loop fastener strip extending latitudinally around the bottom portion of the ball interconnecting the plurality of strips for spacing retention.

The longitudinal hook and loop fastening strips 24 may be spliced at the intersection point or along the side of the ball 22. As shown in FIG. 6, one or more latitudinal hook and loop fastening strip(s) 26 may extend below the midpoint of the ball 22. As shown, in FIG. 6, the strip 26 extends completely around the ball 22; however, individual latitudinal strips may also be employed with one or more solid strips 26 together or independently as desired.

Figure 2:
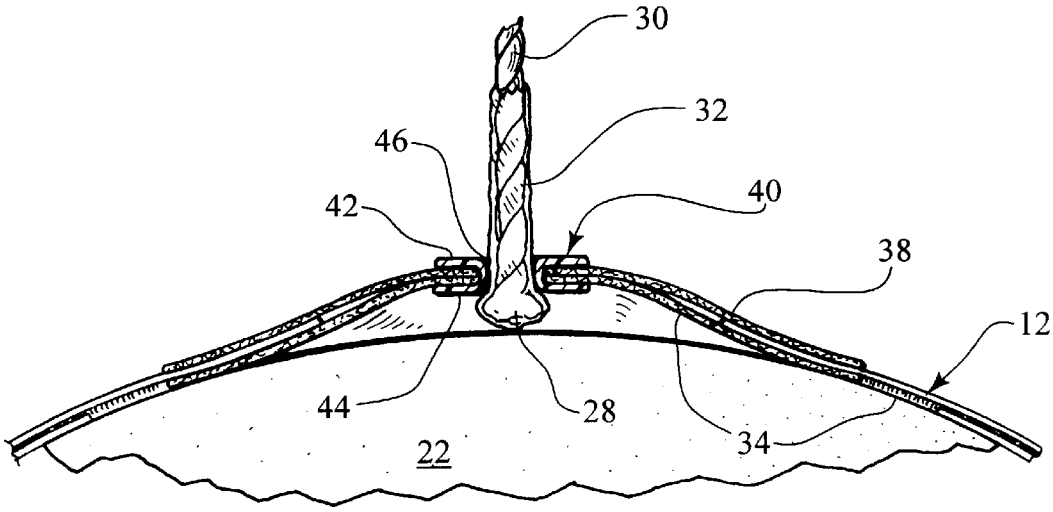
FIG. 2 is a perspective view of a sectional portion of FIG. 1 along lines 1—1, showing the intersection of the hook and loop strips at the axis, a knot at the end of the tether extending through a smooth cover flap secured to the hook and loop fasteners.
Figure 3:
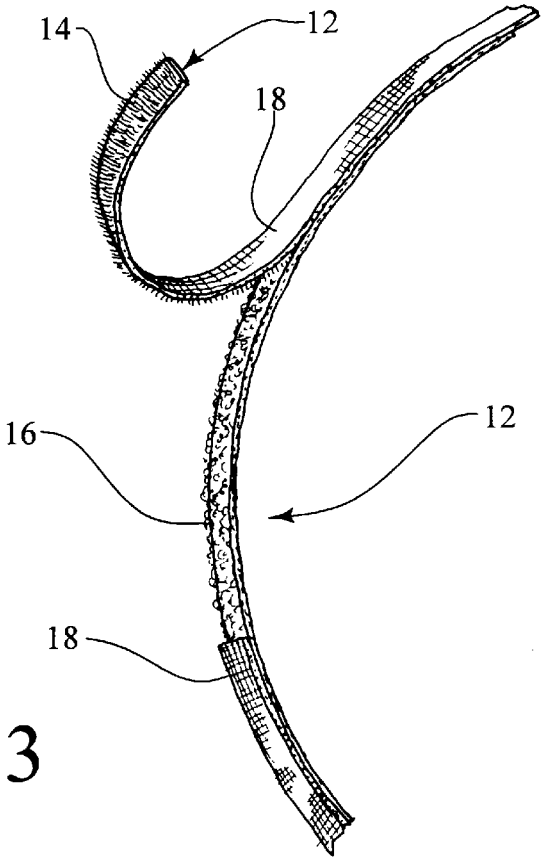
FIG. 3 is a perspective view of the hook and loop fastener strips of FIG. 1, showing the intersection and cooperative engagement of the strips providing a removable and adjustable holding means.

As best shown in FIG. 2, a knot 28 is formed in the rope or line or cord 30 of the tether 20. A coating such as paraffin wax, plastic material, or shrink wrap, is used to provide a protective sheath 32 to aid in prevention and unraveling of the cord 30 and provide a means for unrestricted spinning of the cord 30. The cord 30 may also be formed or molded having a flattened distal end providing a means of attachment. As shown, in FIG. 2, one preferred embodiment includes a first circular flat washer 34 or flap positioned in the center of the ball at the "pole" being fabricated from plastic, leather, or fabric which adheres to the surface of the ball by stitching or glue. The washer 34 is placed at the intersection of the latitudinal strips 12 and the strips are fastened to the top of the washer 34 by attachment means such as glue. A hole is formed in the center of the first flat washer 34 to accommodate the cord 30. A second top generally flat circular washer or flap 38 fabricated from plastic, leather, or fabric is placed over the first washer 34 and intersecting latitudinal strips 12 and secured thereto by means for attachment such as glue. The second washer 38 also includes a hole to accommodate the cord 30. A hollow rivet 40 having upper and lower flanges 42 and 44 respectively, extending from a central collar 46 may also be disposed into the holes of the first washer 34 and second washer 38 used to constrict the first washer 34, strips 12, and second washer 38 and form a smooth interior surface for contact with the cord 30, and a restriction for cooperative engagement with the means for attaching the cord 30 such as the knot 28. Attachment of the cord 30 through the hollow rivet 40 and washers 34 and 38 provide a means for preventing twisting , coiling, or spinning of the cord 30 upon spinning of the ball 22.

Figure 4:
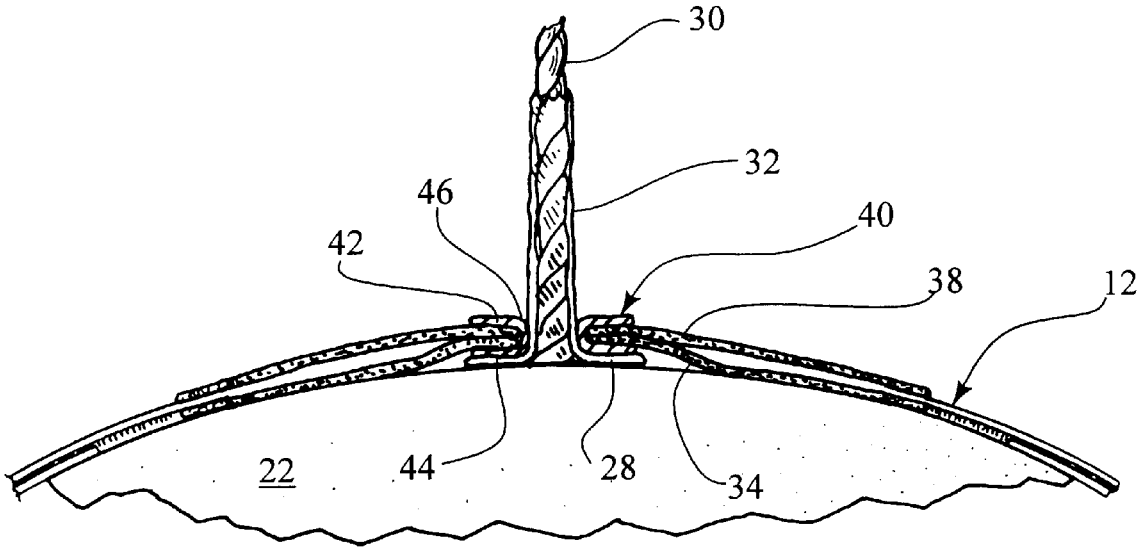
FIG. 4 is a perspective view of the present invention showing the tether attached to the ball surface by holding means allowing a generally flat attachment point under the cover.

FIG. 4 shows an alternative embodiment for attachment of the cord 30 with the ball 22, wherein the cord 30 braids or the sheath 32 surrounding the braids are flattened at a 90 degree angle with respect to the surface of the ball so that the washers 34, 38 are form a generally flat surface with the ball 22, yet enable the ball 22 to spin freely independent of the cord 30.

Figure 5:
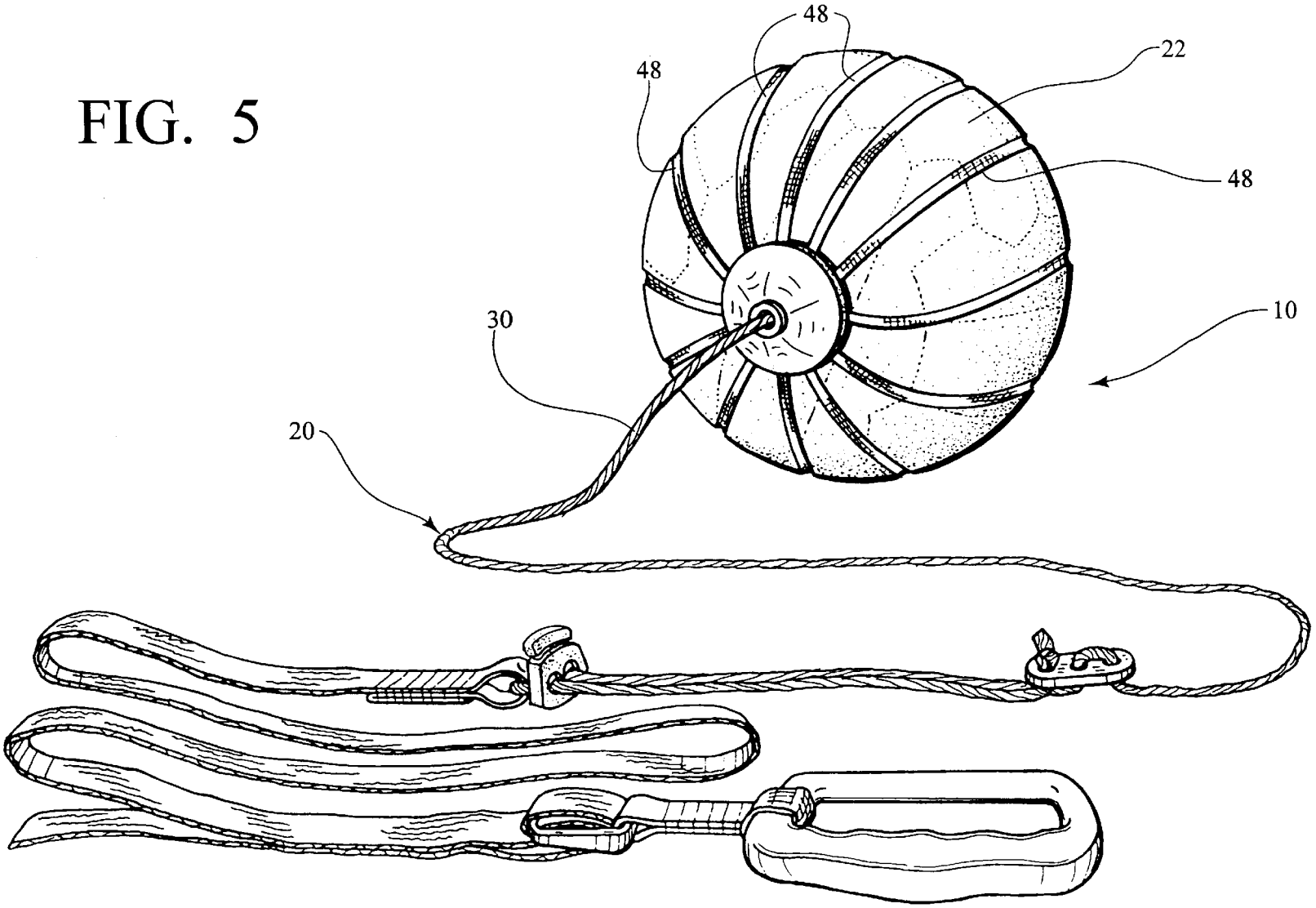
FIG. 5 is a perspective view of an alternate embodiment of the present invention, whereby the removable strips are replaced with seams formed integrally within ball.

As shown in FIG. 5, strips 48 formed of fabric, plastic, leather, or rubber are formed integrally with the ball 22, such as with a basketball wherein the means for attaching the cord 30 to the ball 22 may formed as an attachment to, integrally with, or fused to the ball 22. This arrangement would be particularly attractive if a practice ball would be fabricated and adapted to be used with the tether 20 of the claimed invention providing a smooth surface for kicking the ball 22 with spin. The embodiment shown in FIG. 5, shows the strips 48 embedded within the surface of the ball 22 are slightly concave to provide a better grip.

A leader, (not shown) may also be formed extending from a central point on the ball 22 or attachable thereto. Such as leader would have a free spinning end.

The tether 20 is best illustrated in FIGS. 1, 5, and 6. In the preferred embodiment the cord 30 is fastened directly to the ball. A means for shortening or lengthing the tether 20 is provided by a clip 50; however, a simple loop, or knot in the cord may also be used to adjust the length of the cord 30 portion of the tether. A fastening means such as an adjustable clip 52 having a spring loaded clamp 54 may be used to fasten the cord 30 to an elastic strip 56. Although the present invention provides a means of spinning a ball 22 without the use of elastic, the preferred embodiment utilizes elastic to return the ball to the user.

As shown in the drawings the tether is attached to the cord 30 and handle 58 by loops and also features an adjustable clip 60 for the user or multiple users to adjust the length depending upon the desired return characteristics of the ball 22. The elastic used in the preferred embodiment is braided elastic so that the elastic stretches at a uniform rate rather than to "snap" back. This provides a means to kick the ball 22 coming back to you at about the same rate and momentum as imparted to the ball 22 by the kick moving the ball 22 away from the user. The ball 22 returns to the kicker just as if they were receiving it from another kicker.

Although an elastic strip 56 or cord 30 may be used alone, the tether 20 combining both provides a means of directional control providing predictable returns.

The elastic strip 56 is usually about ⅓ the length of the cord portion. The braided elastic strip 56 used in one preferred embodiment comprises about 50 to about 75 percent polyester and about 25 to about 40 percent rubber, and more particularly about 68 percent polyester and about 32 percent rubber. A handle 58 may be attached to the distal end of the elastic strip 56 opposite the holder. This apportionment allows the user to hold the end of the handle 58 at chest height and kick the ball 22, whereby the ball is forced upward and returns at chest height. Holding the handle 58 lower results in the ball 22 being kicked parallel with the ground. By kicking the ball 22 on one side or the other, spin can be imparted to the ball 22 so that it rises, lowers, or curves to the left, right, or combinations thereof. Thus, adjustment of the elastic 56 so that it is about ⅓ the length of the cord 30 causes the ball 22 return high upon being kicked by the user. The shorter the elastic strip 56 as compared to the cord 30, the higher the ball will rise. This is very helpful in developing ball control for the chest and knees as well as for the feet, such as is important for a goal keeper.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

We claim:

1. A soccer ball spin training tether, comprising:

a ball;

a tether comprising an elastic portion and a cord, said elastic portion being capable of stretching at a uniform rate providing a constant tension;

means for attaching said tether to said ball at a central point including a first flexible washer having a central hole therein attached to a peripheral surface of said ball, a second flexible washer to an outer surface of said first flexible washer and a hollow rivet inserted thereinbetween, said hollow rivet having upper and lower flanges extending from a central collar forming a smooth interior surface for contact with said cord and forming a restriction for cooperative engagement with a distal end of said cord, said distal end of said cord inserted through said rivet attaching said cord thereto and enabling said ball to spin freely independent of said cord and providing a generally flat attachment point;

means for lengthening or shortening said tether and for adjusting the length of said elastic portion with respect to said cord;

said means for attaching said tether comprising an enlarged and flattened distal end formed in said cord of said tether including a coating thereon selected from the group consisting of paraffin wax, plastic, and shrink wrap for providing a protective sheath for preventing unraveling of said cord.

2. The soccer ball spin training tether of claim 1, including a plurality of longitudinal strips extending around said ball and have a means of attachment comprising hook and loop fasteners.

3. The soccer ball spin training tether of claim 2, wherein said longitudinal strips are removable.

4. The soccer ball spin training tether of claim 2, including at least one latitudinal strip extending below a center of said ball.

5. The soccer ball spin training tether of claim 4, wherein said at least one latitudinal strip extends around said ball and includes means for attachment comprising hook and loop fasteners.

6. The soccer ball spin training tether of claim 1, wherein said elastic portion of said tether is about one third the length of the cord portion.

7. The soccer ball spin training tether of claim 1, wherein said elastic portion of said tether is braided material.

8. The soccer ball spin training tether of claim 1, wherein said elastic portion of said tether comprises polyester and rubber.

9. The soccer ball spin training tether of claim 8, wherein said elastic portion comprises material ranging from about 50 to about 75 percent polyester and about 25 to about 40 percent rubber.

10. The soccer ball spin training tether of claim 9, wherein comprises about 68 percent polyester and about 32 percent rubber.

11. The soccer ball spin training tether of claim 1, including a shaped handle forming a closed loop extending from a distal end of said tether.

12. The soccer ball spin training tether of claim 1, including a means for lengthening or shortening said tether comprising a clip.

13. The soccer ball spin training tether of claim 1, wherein said tether includes a fastening means comprising an adjustable clip having a spring loaded clamp for adjusting the length of said elastic portion with respect to said cord.

14. A soccer ball spin training tether, comprising:

a ball;

a tether comprising an elastic portion and a cord;

a plurality of longitudinal strips spaced apart from one another and being attached to said ball, said longitudinal strips extending around said ball and have a means of attachment comprising hook and loop fasteners, said ball being rotatable with respect to said tether; and said means for attaching said tether to said ball including a first flexible washer having a central hole therein attached to a peripheral surface of said ball, said longitudinal strips attached to said first circular washer, a second flexible washer attached to the top of said longitudinal strips, and a hollow rivet inserted between said first flexible washer and said second flexible washer compressing same, and the distal end of said cord inserted through said rivet providing means for said ball to rotate and spin around said cord.

15. The soccer ball spin training tether of claim 14, wherein said longitudinal strips are removable.

16. The soccer ball spin training tether of claim 14 including at least one latitudinal strip extending below a center and around said ball.

17. The soccer ball spin training tether of claim 14, including a means for lengthening or shortening said tether.

18. The soccer ball spin training tether of claim 14, wherein said elastic portion of said tether is about one third the length of the cord portion.

19. The soccer ball spin training tether of claim 14 wherein said elastic portion of said tether is comprises polyester and rubber.

20. The soccer ball spin training tether of claim 14 including a handle extending from a distal end of said tether.

* * * * *